US007690175B2

(12) United States Patent
Ballestrazzi et al.

(10) Patent No.: US 7,690,175 B2
(45) Date of Patent: Apr. 6, 2010

(54) METHOD FOR THE PACKAGING OF ARTICLES WITH A FILM OF PLASTIC MATERIAL

(75) Inventors: Aris Ballestrazzi, Savignano Sul Panaro Modena (IT); Lamberto Tassi, Savignano Sul Panaro Modena (IT)

(73) Assignee: Sitma S.p.A., Spilamberto (Modena) (IT)

( * ) Notice: Subject to any disclaimer, the term of this patent is extended or adjusted under 35 U.S.C. 154(b) by 160 days.

(21) Appl. No.: 11/825,788

(22) Filed: Jul. 9, 2007

(65) Prior Publication Data

US 2008/0010951 A1 Jan. 17, 2008

(30) Foreign Application Priority Data

Jul. 17, 2006 (IT) ..... MI2006A1382

(51) Int. Cl.
*B65B 11/02* (2006.01)

(52) U.S. Cl. ..... 53/461; 53/450; 53/548; 53/550

(58) Field of Classification Search ..... 53/450, 53/456, 461, 469, 548, 550, 555
See application file for complete search history.

(56) References Cited

U.S. PATENT DOCUMENTS 3,229,442 A 1/1966 Gram
3,320,718 A * 5/1967 Thesing ..... 53/551
3,585,623 A * 6/1971 Laukaitis ..... 340/640
3,736,723 A * 6/1973 Lattke ..... 53/557
3,807,117 A * 4/1974 Abrams ..... 53/398
3,943,683 A * 3/1976 Kovacs et al. ..... 53/51
4,299,075 A * 11/1981 Gram ..... 53/550
4,305,240 A * 12/1981 Grevich et al. ..... 53/374.6
4,546,595 A * 10/1985 Yasumune et al. ..... 53/450
4,670,279 A * 6/1987 Lesch ..... 426/410
4,807,420 A 2/1989 Barker
4,870,802 A * 10/1989 Cerf ..... 53/442
4,872,302 A * 10/1989 van Eijsden et al. ..... 53/441
5,237,800 A 8/1993 Omori
5,271,210 A * 12/1993 Tolson ..... 53/550
5,329,745 A * 7/1994 Suga ..... 53/75
5,337,542 A * 8/1994 Omori ..... 53/550
6,481,188 B1 * 11/2002 Graham et al. ..... 53/479
2004/0082457 A1 * 4/2004 Latronico ..... 493/394
2004/0250515 A1 12/2004 Rimondi
2005/0178095 A1 * 8/2005 Rimondi ..... 53/550

OTHER PUBLICATIONS

International Search Report dated Oct. 16, 2007.

* cited by examiner

*Primary Examiner*—Thanh K Truong
(74) *Attorney, Agent, or Firm*—Hedman & Costigan, P.C.; James V. Costigan

(57) ABSTRACT

Method for the packaging of articles with a plastic film which is based on the use of a packaging machine equipped with transverse welding devices arranged along a longitudinal direction where the method involves the steps of (a) positioning the articles on a conveyor belt with pushers activated by a motor; (b) distancing the articles from one another to provide a constant space or pitch; (c) feeding the plastic film, in the direction of the conveyor belt; (d) longitudinally welding the film in the direction articles on the conveyor belt; (e) activating the motor group situated downstream with respect to the welding device to weld and separate the film in the space between articles; and (f) activating the motor group of the welding device situated upstream with respect to another welding device to weld and separate the film in the space between the articles.

6 Claims, 6 Drawing Sheets

METHOD FOR THE PACKAGING OF ARTICLES WITH A FILM OF PLASTIC MATERIAL

The present invention relates to a method for the packaging of articles with a film made of plastic material.

As is known, editorial products such as books, magazines or newspapers are packaged either individually or together with other similar products or gadgets, with transparent films and not made of polyethylene, PVC or other similar material, in order to protect them from external damage and in any case guarantee adequate preservation during storage and in subsequent transportation until they are purchased on the part of the final consumer.

The packaging must be effected so that the film which forms the packaging adheres to the product in the best possible way, in order to protect it as much as possible it and present it to the user in a pleasant aesthetical form.

The known equipment for the packaging of articles with a film of plastic material normally consists of a feeder which continuously transfers the products to be packaged to a conveyor belt. The conveyor belt then sends the products towards a packaging station, into which the film is fed for their wrapping.

A first longitudinal welding device effects the closing of the film, in a longitudinal advance direction of the conveyor belt, so as to form a tubular casing which envelops the products aligned on the belt. Finally, a transversal welding device effects the closing in a transversal direction of each packaging, separating the products definitively packaged and ready for distribution.

On some known types of equipment, there are two consecutive transversal welding stations, alternatingly activated to accelerate the forming operations of the packaging. On the basis of a known packaging method embodied on said machines, the transversal welding station situated upstream with respect to the advance direction of the conveyor belt, is first activated producing a packaging in which two adjacent products are temporarily present. The transversal welding station situated downstream is subsequently activated to separate the two products from each other, forming the definitive packagings. Some phases of a method of this type are shown, for illustrative purposes, in FIG. 1 of the enclosed drawings.

One of the drawbacks that arises with this particular packaging method, however, is due to the fact that, when the first transversal welding is effected, there is a withdrawal of the tubular casing which temporarily envelops the two products, the longitudinal welding of the film having already been previously effected.

This withdrawal condition with respect to the advance direction of the conveyor belt, indicated by the arrows illustrated in FIG. 2 of the enclosed drawings, can lead to the weakening of the transversal weldings of the casing, especially as far as the first head welding is concerned, indicated with A, and also to an excessive stretching of the material of which the film is made, with the consequent formation of packagings having a poor resistance.

Furthermore, it may also happen that the two products present in the packaging are brought closer together, i.e. decreasing the pre-established distance or pitch D between contiguous products on the conveyor belt, and also the intermediate transversal welding, effected by the welding station situated downstream, may be weakened.

An objective of the present invention is therefore to provide a method for the packaging of articles with a film of plastic material, using in particular a machine equipped with two transversal welding stations, capable of solving the problems of the known methods, avoiding weak transversal weldings which could jeopardize a good packaging of the products.

A further objective of the invention is to provide a method for the packaging of articles with a film of plastic material which can be applied to traditional packaging machines with minimum adjustments.

Another objective is to provide a method for the packaging of articles with a film of plastic material which is particularly simple and functional, with reduced costs.

These objectives according to the present invention are achieved by providing a method for the packaging of articles with a film of plastic material as specified in claim 1.

Further characteristics of the invention are indicated in the subsequent claims.

The characteristics and advantages of a method for the packaging of articles with a film of plastic material according to the present invention will appear more evident from the following illustrative and non-limiting description, referring to the enclosed schematic drawings, in which.

Figure 1:
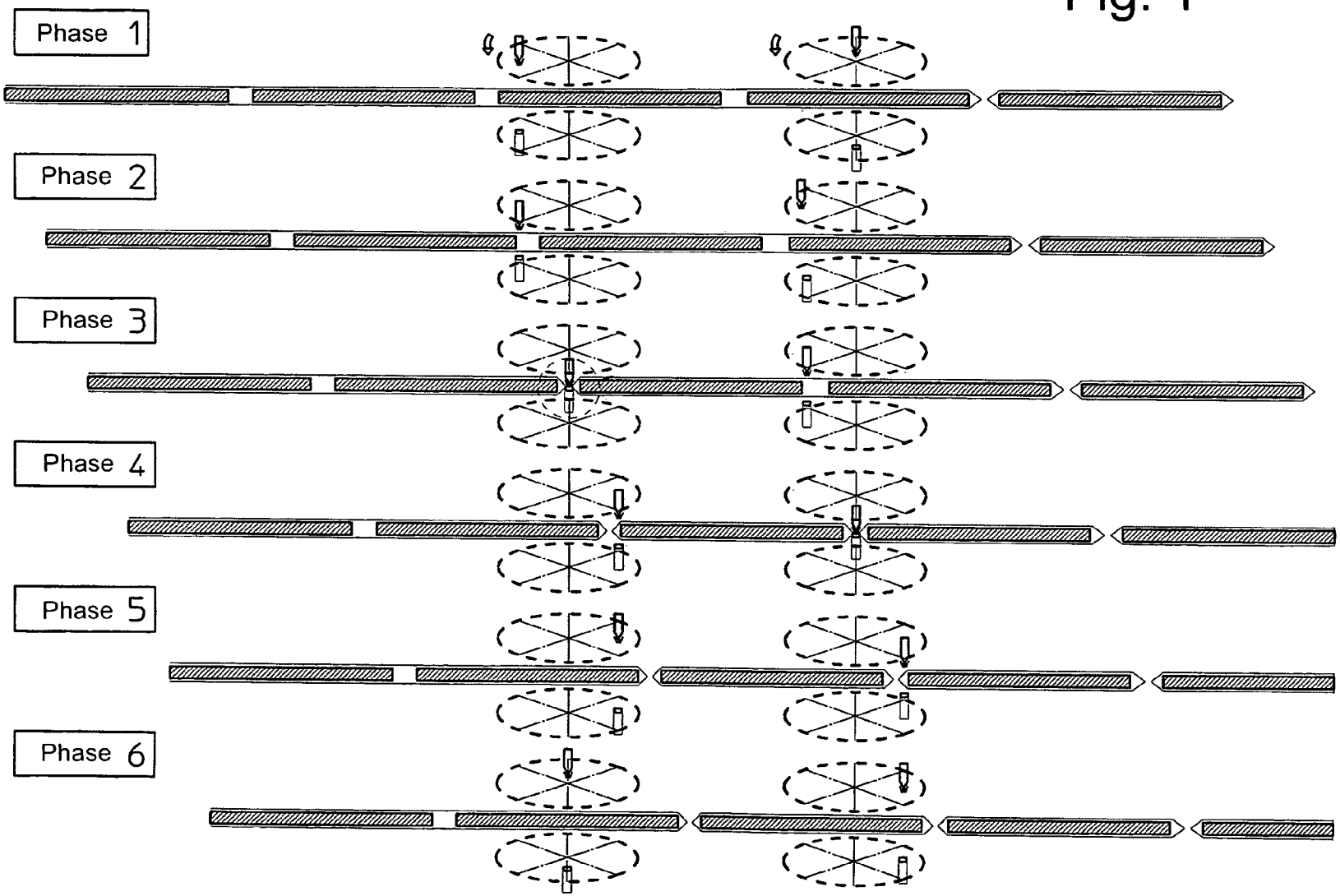
FIG. 1 is a schematic representation of some phases of a traditional method for the packaging of articles with a film of plastic material, using a packaging machine equipped with two transversal welding stations.
Figure 2:
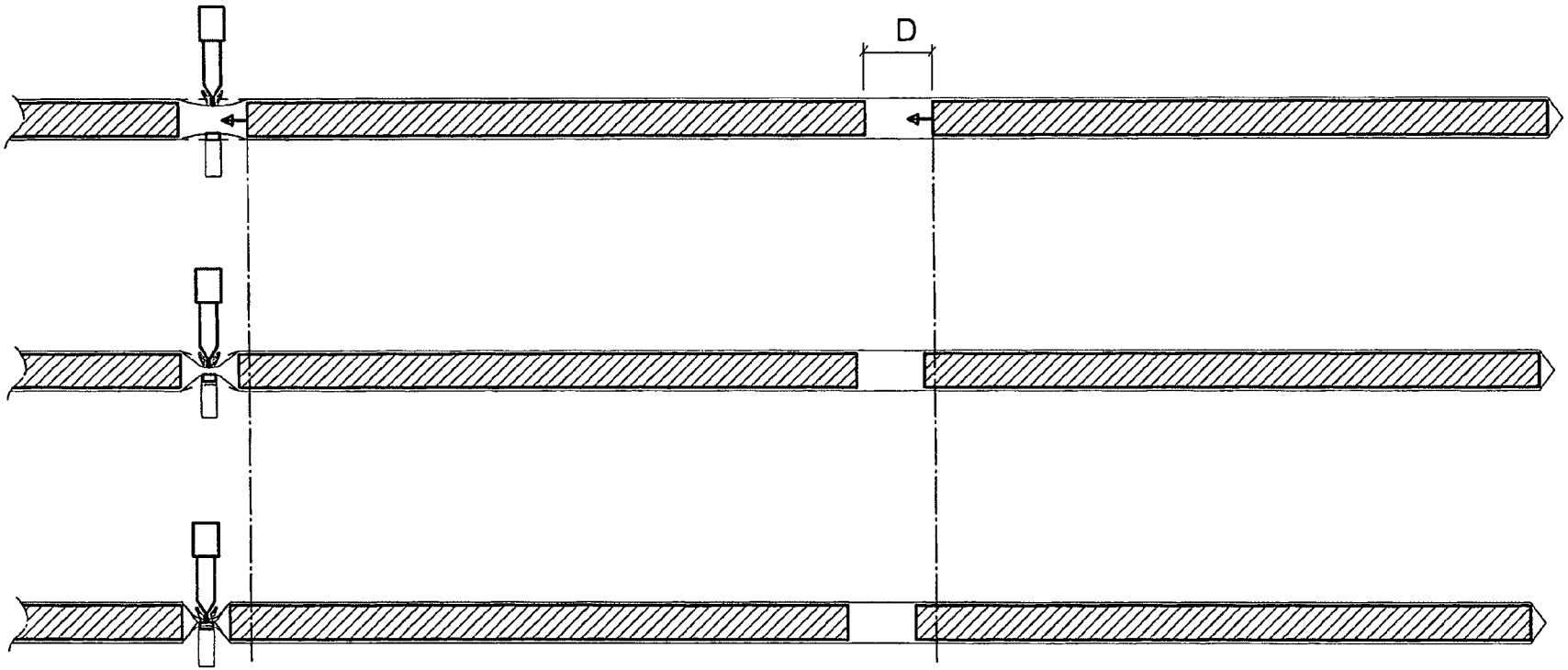
FIG. 2 is a schematic representation in detail of one of the transversal welding phases illustrated in FIG. 1.
Figure 3:
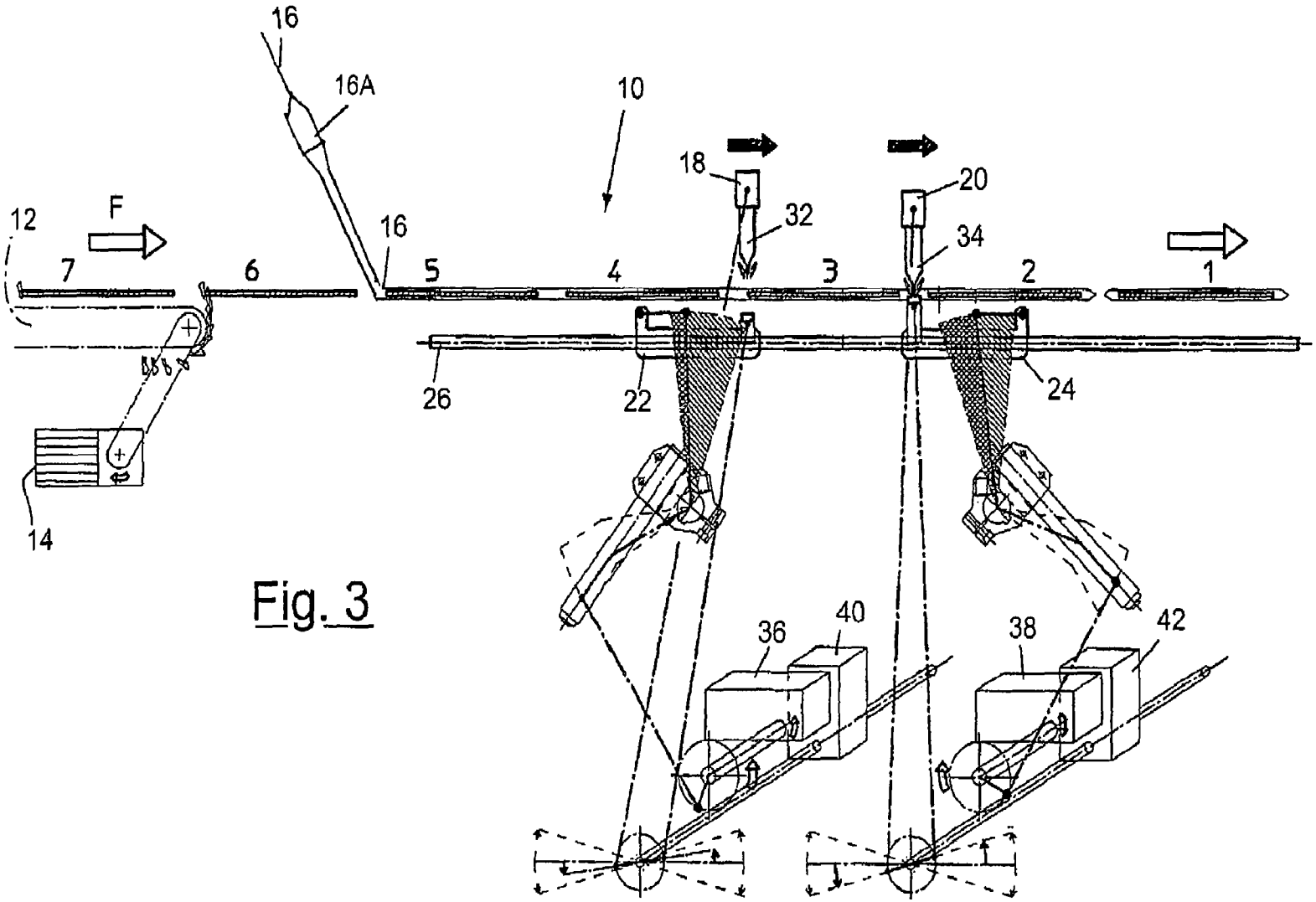
FIG. 3 is a schematic representation of a packaging machine, equipped with two transversal welding stations, in which a first phase of the method for the packaging of articles with a film of plastic material according to the present invention, is activated.
Figure 3A:
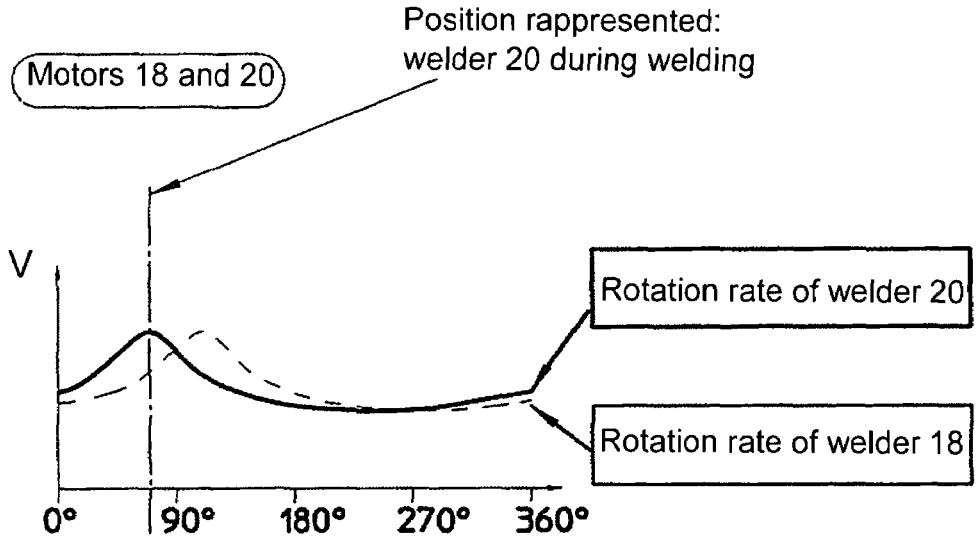
Figure 3B:
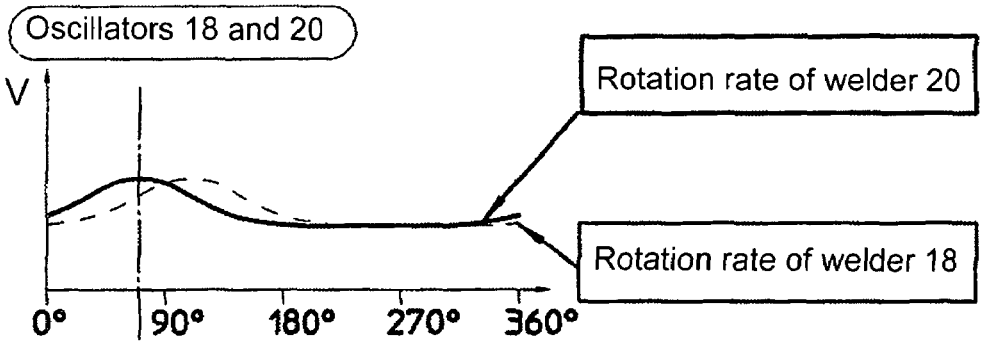
Figure 4:
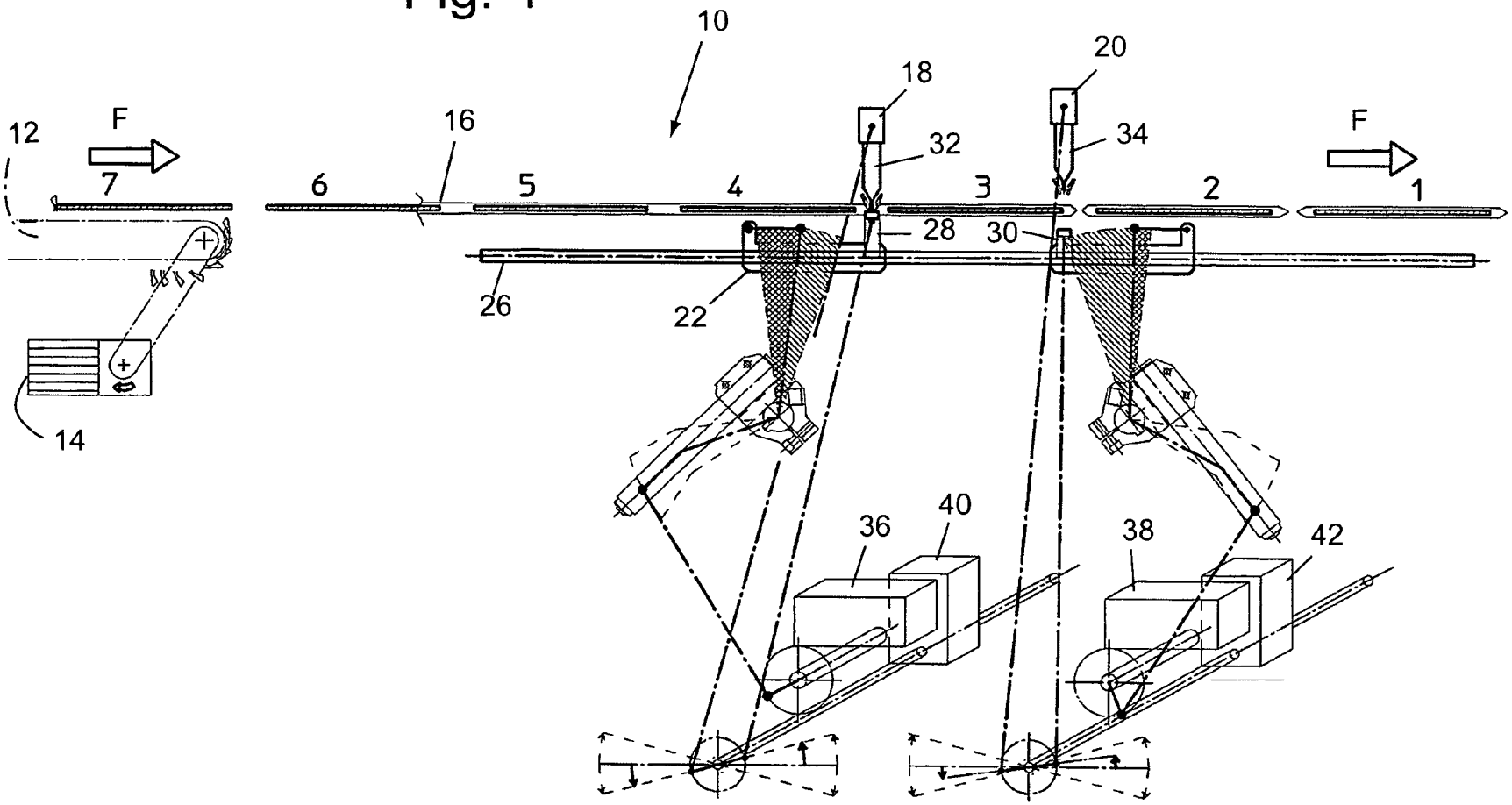
Figure 4A:
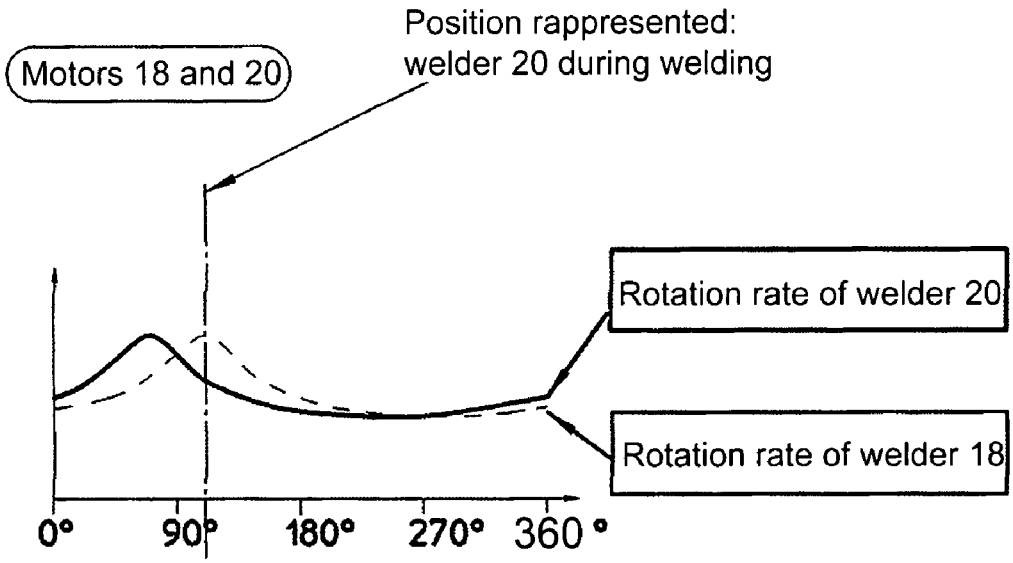
Figure 4B:
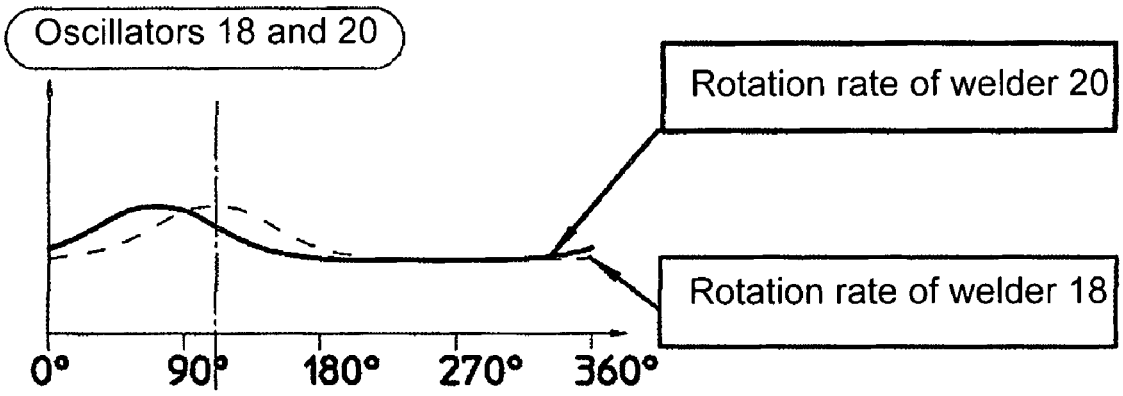

FIGS. 3A and 3B respectively represent the velocity curves of the motor and oscillator associated with the two transversal welding stations with particular reference to the first packaging phase illustrated in FIG. 3;

FIG. 4 is a schematic representation of a packaging machine, equipped with two transversal welding stations, in which a second phase of the method for the packaging of articles with a film of plastic material according to the present invention, is activated; and FIGS. 4A and 4B respectively represent the velocity curves of the motor and oscillator associated with the two transversal welding stations with particular reference to the second packaging phase illustrated in FIG. 4.

With reference in particular to FIGS. 3 and 4, these schematically show a packaging machine, indicated as a whole with 10, on which a method is embodied for the packaging of articles with a film of plastic material according to the present invention.

The articles to be packaged, numbered from 1 to 7 starting from that situated downstream, are positioned on a conveyor belt 12 equipped with pushers, only partially illustrated and activated by a motor 14, which moves in the direction indicated by the arrows F. A suitable roll and counter-roll mechanism (not shown) distances the articles 1-7 from each other so that a constant space, or pitch, is present between them.

A film 16 of plastic material destined for wrapping the articles 1-7 to be packaged, is then fed, in the advance direction F of the conveyor belt 12. The film 16 is first welded longitudinally 16A, i.e. in the direction F, so as to form a tubular casing which wraps the articles 17 aligned along the conveyor belt 12, the articles 1-7 thus wrapped then reach a transversal welding station, consisting of a first transversal welding device 18 and a second transversal welding device 20 situated downstream, in the direction of the arrow F, with respect to the first device 18.

Each of the two transversal welding devices 18 and 20 is assembled, in a known way, on respective opposite trolleys 22 and 24, capable of moving along a rail 26 coaxial with respect to the conveyor belt 12 and situated below it. An anvil 28, 30 is situated on each trolley 22, 24, capable of opposing the action of the welding head 32, 34 of each device 18, 20 during the welding and cutting action of the film 16.

A motor 36, 38 and a relative oscillator 40, 42 are associated with each of the two transversal welding devices 18 and 20. The function of the motors 36 and 38 is to allow the movement of the devices 18 and 20 and their associated trolleys 22 and 24, so that the welding heads 32 and 34 are situated exactly in correspondence with the spaces between the adjacent articles 1-7 during the transversal welding phases of the film 16. The oscillators 40 and 42, produced in the form of cam mechanisms, on the other hand, allow the lifting and lowering of the devices 18 and 20 and consequently their welding heads 32 and 34 and the anvils 28 and 30 with respect to the plane on which the articles 1-7 are situated.

According to the invention, with reference in particular to FIG. 3, during the transversal welding phase of the film 16 the welding device 20 situated downstream with respect to the device 18 in the advance direction F of the belt 12, is activated first so that the relative sliding of the film 16, caused by the welding action, with respect to the article 2 in the closing phase, does not jeopardize a good welding of the article 1 which precedes it, already packaged previously.

Following the activation of the welding device 20 downstream, the device 18 upstream with respect to this (FIG. 4) is then activated so as to effect the rear closing of the article 3 already welded in the front during the closing phase of the article 2. In this way, every article is packaged individually, as in the case of machines equipped with a single transversal welding station, there being no variations in the position of the portion of film 16 which wraps the semi-processed articles.

Furthermore, as indicated in FIGS. 3A and 4A, at the moment of the transversal welding, the rotation rate of the motor 36, 38 of the device 18, 20 presently in the welding phase, is increased in order to compensate possible longitudinal movements of the film 16 with respect to the plane of the conveyor belt 12. In the same way, the rotation rate of the oscillator 40, 42 associated with the welding device 18, 20 is also increased as soon as it begins operating (FIGS. 3B and 4B).

On the basis of the transversal welding method according to the invention, and with the exception of the velocity increases described above, the rotation rate of the motors 36 and 38 of the welding devices 18 and 20 is established at half the rotation rate of the motor 14 which moves the conveyor belt 12 forward.

Depending on the length of the articles 1-7 to be packaged and in relation to the packaging pitch, it is finally possible to vary the translation degree of the trolleys 22 and 24 and consequently the overall movement range of the transversal welding devices 18 and 20.

In any case, it is possible to activate the motors 36 and 38 of each welding device 18, 20 separately so that the packaging machine 10 can be used as if it were equipped with only one welding station.

It can thus be seen that the method for the packaging of articles with a film of plastic material according to the present invention achieves the objectives specified above, as the movements of the film during the welding phases do not involve the articles already totally or partially packaged, but possibly the products still to be packaged, so that the necessary adjustments can be effected on the packaging machine to obtain homogeneous packagings and with particularly strong transversal weldings.

The method for the packaging of articles with a film of plastic material according to the present invention thus conceived can undergo numerous modifications and variants, all included in the same inventive concept. Furthermore, the details can be substituted with technically equivalent elements. In practice, the materials used, as also the dimensions, can vary according to technical requirements.

The invention claimed is:

1. A method for the packaging of articles (1/7) with a film (16) made of plastic material, using a packaging machine (10) equipped with two transversal welding devices (18; 20) situated in succession along a longitudinal direction (F), comprising the following phases: positioning said articles (1/7) on a conveyor belt (12) with pushers which moves in a longitudinal direction (F) activated by a conveyor motor (14); distancing said articles (1/7) by means of a mechanism so that between each of said articles (1/7) there is a constant space or pitch; feedingthe film (16) destined for wrapping the articles (1/7) to be packaged, in the advance direction (F) of said conveyor belt(12); longitudinally welding the film (16), in the advance direction (F) of the conveyor belt (12), so as to form a tubular casing which envelops said articles (1/7) aligned along said conveyor belt (12); activating a motor (38) and an oscillator (42) of the welding device (20) situated downstream with respect to the welding device (18) in a longitudinal direction (F) to weld and separate said film (16) in the portion of space between one article (2) and the subsequent article (3); and activating a motor (36) and an oscillator (40) of the welding device (18) situated upstream with respect to said welding device (20) in a longitudinal direction (F) to weld and separate said film (16) in the portion of space between said article (3) and the subsequent article (4) wherein the rotation rate of the motor (36; 38) and oscillator (40; 42) of each transversal welding device (18; 20) is increased with respect to the rotation rate of the conveyor motor (14) which moves said conveyor belt (12) forward so as to compensate for longitudinal movements of the film (16) with respect to the conveyor belt (12).

2. The method according to claim 1, characterized in that the rotation rate of said motors (36; 38) is established at half the rotation rate of said motor (14).

3. The method according to claim 1, characterized in that the rotation rate of said motors (36; 38) is increased when each of said devices (18; 20) is in the welding phase, so as to compensate possible longitudinal movements of said film (16) with respect to the plane of said conveyor belt (12).

4. The method according to claim 1, characterized in that the rotation rate of said oscillators (40; 42) is increased when each of said devices (18; 20) is in the welding phase.

5. The method according to claim 1, characterized in that each of said transversal welding devices (18; 20) is capable of translating in a longitudinal direction (F) with respect to said conveyor belt (12).

6. The method according to claim 5, characterized in that the translation degree of each of said transversal welding devices (18; 20) is variable in relation to the length of the articles (1-7) to be packaged and the space, or packaging pitch, between said articles (1-7).

* * * * *